US006782905B2

(12) United States Patent
Chu et al.

(10) Patent No.: US 6,782,905 B2
(45) Date of Patent: Aug. 31, 2004

(54) CONVERTIBLE PLAY STRUCTURE

(75) Inventors: Wan-sing Chu, Sheung Wan (HK); Lai-ha Wu, Sheung Wan (HK)

(73) Assignee: Best Tide Mfg. Co., Ltd., Sheung Wan (HK)

( * ) Notice: Subject to any disclaimer, the term of this patent is extended or adjusted under 35 U.S.C. 154(b) by 93 days.

(21) Appl. No.: 10/124,623

(22) Filed: Apr. 17, 2002

(65) Prior Publication Data

US 2003/0196690 A1 Oct. 23, 2003

(51) Int. Cl.[7] ..... E04H 15/44; E04H 15/48
(52) U.S. Cl. ..... 135/143; 135/126; 135/95
(58) Field of Search ..... 135/125, 126, 135/128, 143, 117, 95

(56) References Cited

U.S. PATENT DOCUMENTS

| | | | | |
|---|---|---|---|---|
| 3,987,580 | A | 10/1976 | Ausnit | 46/25 |
| 4,073,105 | A | 2/1978 | Daugherty | 52/169.9 |
| 4,825,892 | A | 5/1989 | Norman | 135/104 |
| 5,038,812 | A | 8/1991 | Norman | 135/104 |
| 5,301,705 | A | 4/1994 | Zheng | 135/104 |
| 5,411,046 | A | 5/1995 | Wan | |
| 5,467,794 | A | 11/1995 | Zheng | 135/125 |
| 5,560,385 | A | 10/1996 | Zheng | 135/126 |
| 5,579,799 | A | 12/1996 | Zheng | 135/126 |
| 5,664,596 | A | 9/1997 | Zheng | 135/126 |
| 5,778,915 | A | 7/1998 | Zheng | 135/126 |
| 5,816,279 | A | 10/1998 | Zheng | 135/126 |
| 6,109,281 | A | 8/2000 | Lowenthal | 135/125 |
| 6,155,281 | A | 12/2000 | Zheng | 135/126 |
| 6,269,826 | B1 | 8/2001 | Zheng | 135/126 |
| 6,305,396 | B1 | 10/2001 | Zheng | 135/126 |
| 6,328,050 | B1 | 12/2001 | McConnell | 135/137 |
| 6,390,111 | B2 | 5/2002 | Zheng | 135/126 |
| 6,499,498 | B1 | 12/2002 | Zheng | 135/125 |
| 2001/0011550 | A1 | 8/2001 | Zheng | |

FOREIGN PATENT DOCUMENTS

WO WO 01/40603 A1 6/2001

OTHER PUBLICATIONS

Yu Zheng, U.S. Ser. No. 08/639,530, filed May 1, 1996.
Yu Zheng, U.S. Ser. No. 09/162,086, filed Sep. 29, 1998.

*Primary Examiner*—Robert Canfield
(74) *Attorney, Agent, or Firm*—Ladas & Parry

(57) ABSTRACT

A portable and reversible collapsible structure that contains a bottom panel and a plurality of side panels. Each of the side panels contains a fabric material attached to at least one frame with each frame foldable between an expanded position and a recoiled position. At least two side panels are hingedly connected to opposing sides of the bottom panels. At least one detachable side panel is further attached to the bottom panel and in a position that is in between the opposing side panels. The connection between the detachable side panel and the bottom panel is reversible and detachable by a user. The connection between the detachable side panel and one of the opposing side panels is also reversible according to the needs of a user.

18 Claims, 19 Drawing Sheets

CONVERTIBLE PLAY STRUCTURE

FIELD OF INVENTION

The present invention is related to collapsible toy structures such as tents and playhouses.

BACKGROUND OF INVENTION

Collapsible structures that are used for playhouses are well-known in the art. They are typically collapsible into a small volume but can be easily popped up by various means, including the use of extendable frames and inflatable tubes. U.S. Pat. No. 6,305,396 described a collapsible structure that is provided with a plurality of foldable frame members each having a folded and an unfolded orientation. A fabric material is provided for covering a portion of each frame member to form a side panel therefrom. The structure may be folded and stored by folding the side panels and their corresponding frame members on top of each other about the hinge portions to have the side panels and frame members overlying each other. The overlying side panels and frame members are then collapsed by twisting and folding to form a plurality of concentric frame members to substantially reduce the size of the structure.

The above described structure has many advantages, but has the limitation of not being able to have substantially different sizes for the side panels. It is therefore an object to have present invention to provide improved collapsible structures.

SUMMARY OF INVENTION

Accordingly, the present invention provides a portable and reversibly collapsible structure that contains a bottom panel and a plurality of side panels. Each of the side panels contain a fabric material attached to at least one frame with each frame foldable between an expanded position and a recoiled position. At least two side panels are hingedly connected to opposing sides of the bottom panel. At least one detachable side panel is further attached to the bottom panel and in a position that is in between the opposing side panels. The connection between the detachable side panel and the bottom panel is reversible and detachable by a user. The connection between the detachable side panel and one of the opposing side panels is also reversible according to the needs of a user.

According to one embodiment, the bottom panel assumes a quadrilateral shape having two opposing edges interposing two opposing ends. Two side panels are connected to the opposing edges of the bottom panel (these two side panels are also referred to as the first and second connected side panels for ease of the description) while a first and second detachable side panels are provided at the two opposing ends. The first detachable side panel is provide with attachment means at the bottom for detachable attachment to one of the ends of the bottom panel. The first detachable side panel also contains an attachment means for detachable attachment to one side to the second connected side panel but is hingedly connected to one side of the first connected side panel. The second detachable side panel is detachably connected at the bottom to the other end of the bottom panel. This second detachable side panel is also provided with an attachment means for detachable attachment to one side of the first connected side panel but is hingedly attached on the other side to the second connected side panel.

In a second embodiment, the two detachable side panels are completely detachable from the bottom and the two connected panels.

In a third embodiment, the two connected side panels each contains two frames that are hingedly adjoined side by side to form a single side panel.

A distinct advantage of the instant invention is that the collapsible structure according to the present invention is extremely flexible in terms of size and shapes. Rectangular structures with the long side substantially longer than the short end, may be made and easily collapsible similar to the equilateral shape that was previously provided in the art. Furthermore, there is an added advantage of the second embodiment being able to interchange one or both end panels such that different shapes and functions may be substituted conveniently. The present invention thus provide a truly versatile and inter-convertible structure.

DETAILED DESCRIPTION

Figure 1A:
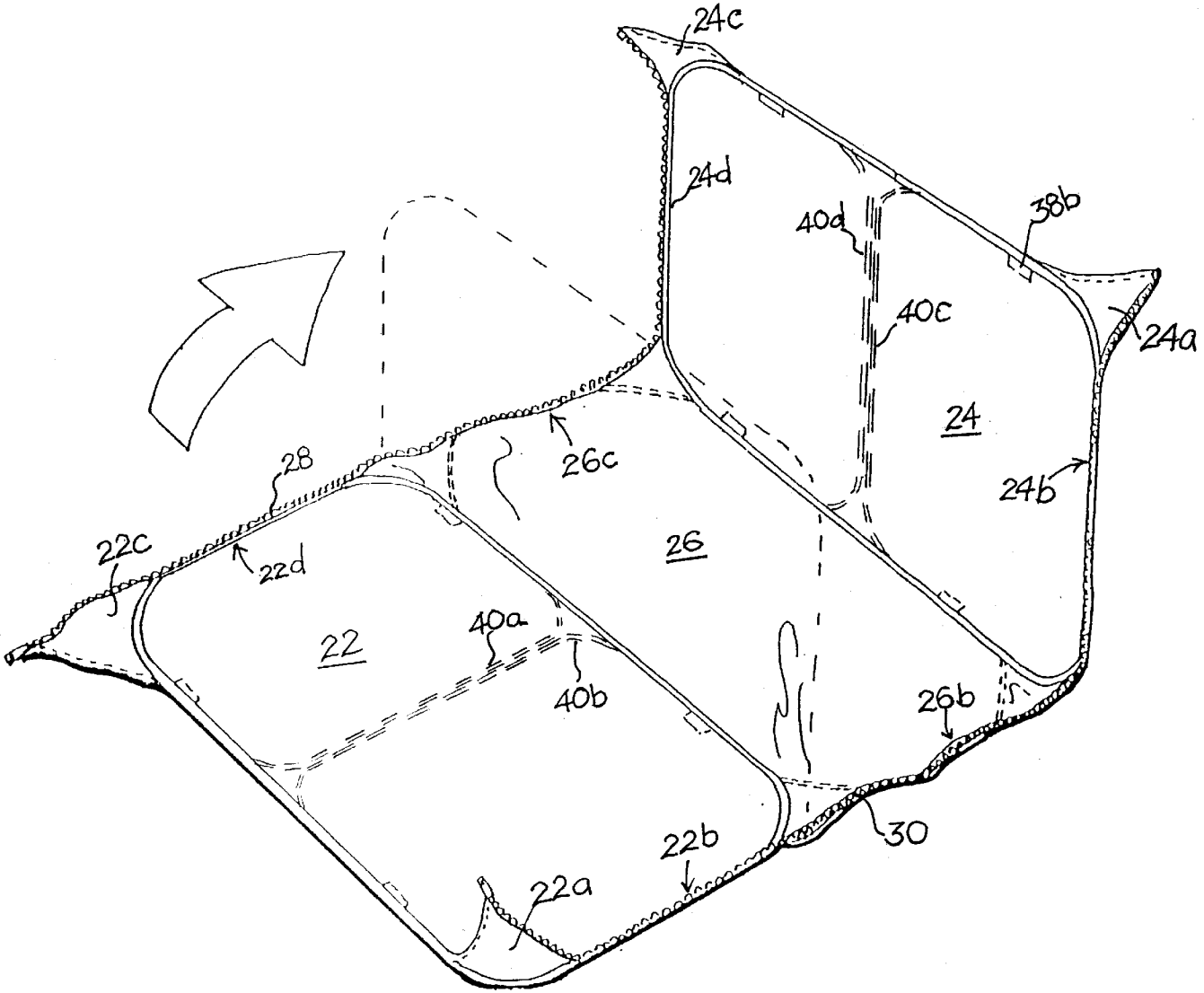
FIG. 1A is a drawing of a partial structure according to one embodiment of the present invention showing the two side panels that are hingedly connected to the bottom panel.
Figure 1B:
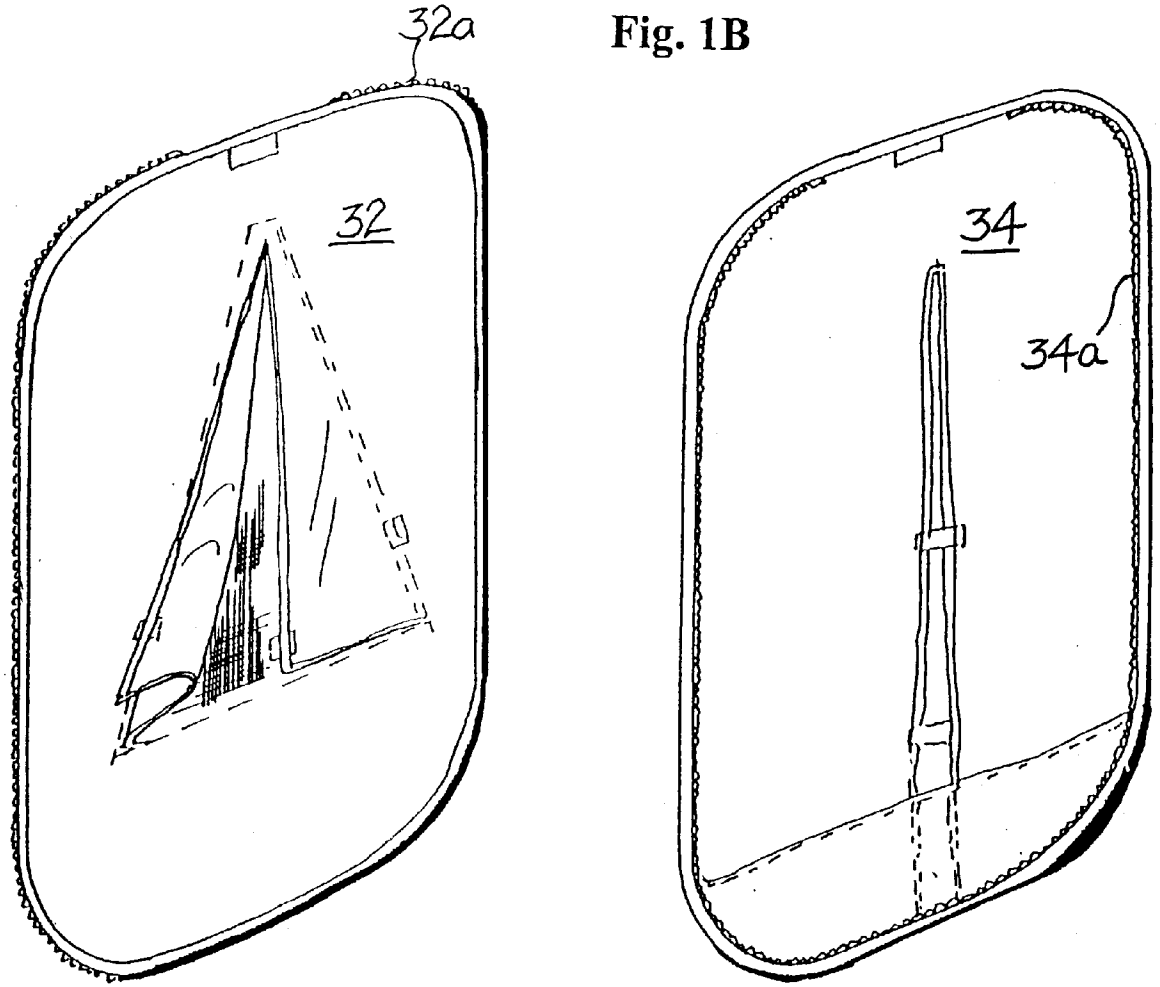
FIG. 1B shows the two detachable end panels according to the same embodiment as FIG. 1A.
Figure 1C:
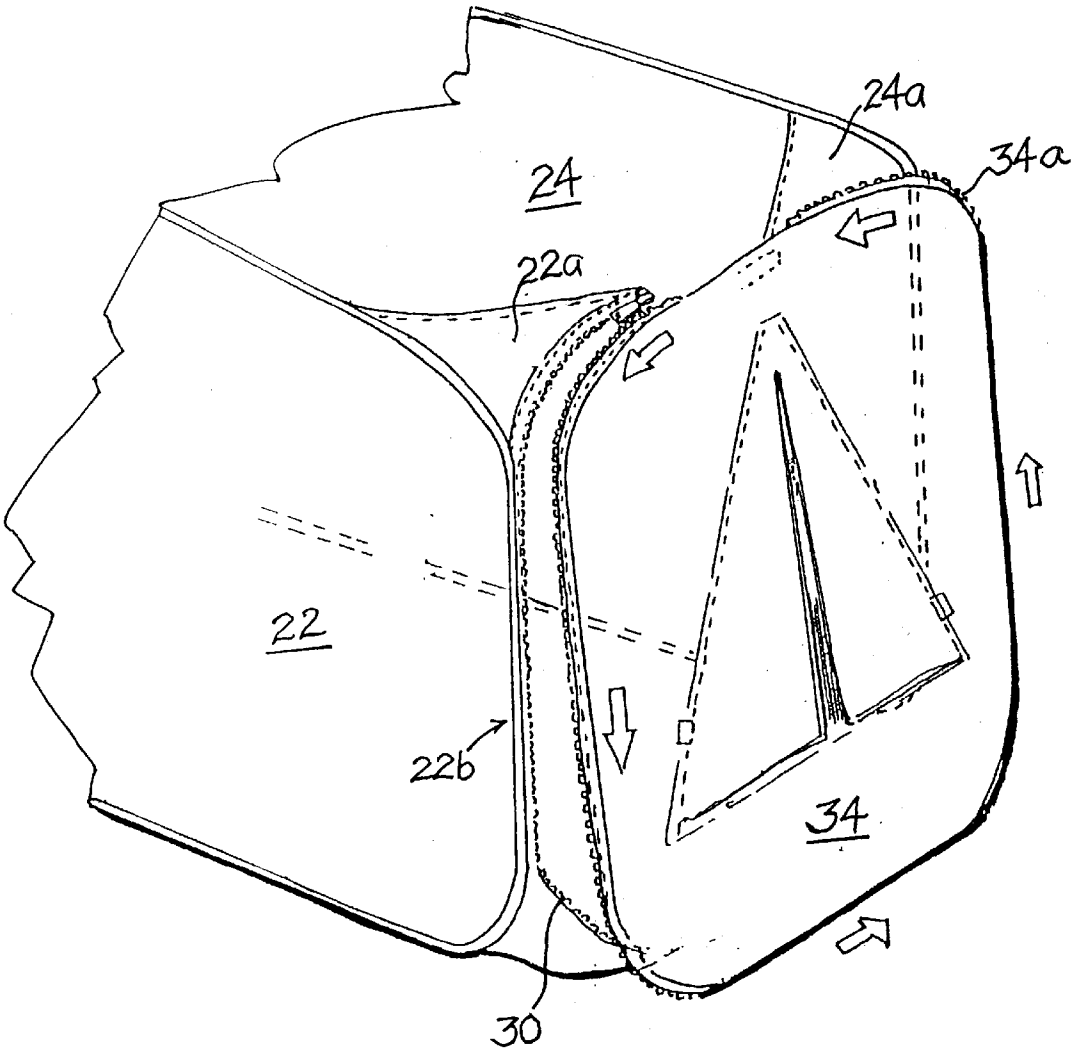
FIG. 1C shows a portion of the same embodiment as FIGS. 1A and 1B showing a zipper as the attachment means for attaching the detachable panel onto the connected side panel and bottom panel.
Figure 1D:
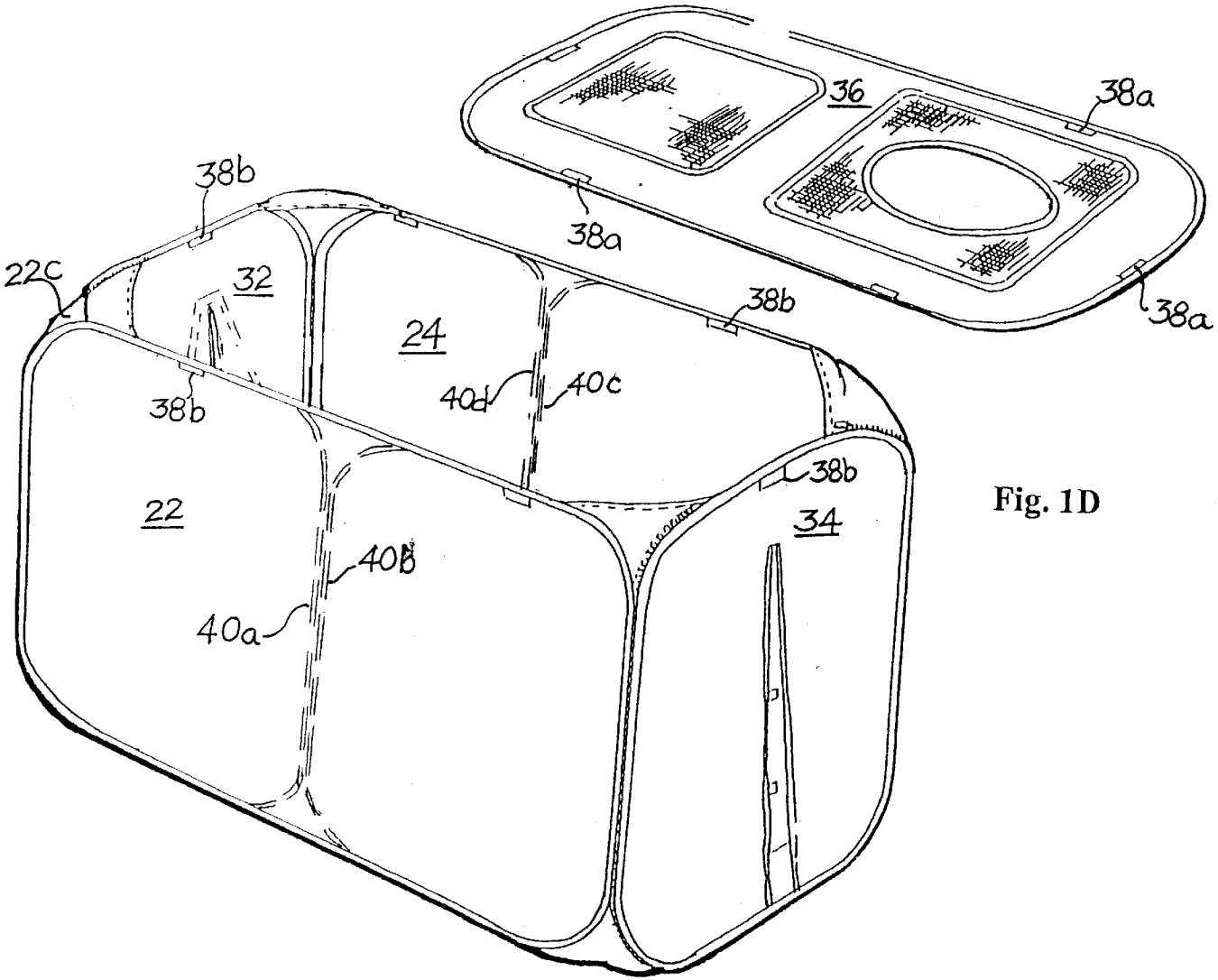
FIG. 1D shows a perspective view of the same embodiment with the top of the structure detached.
Figure 1E:
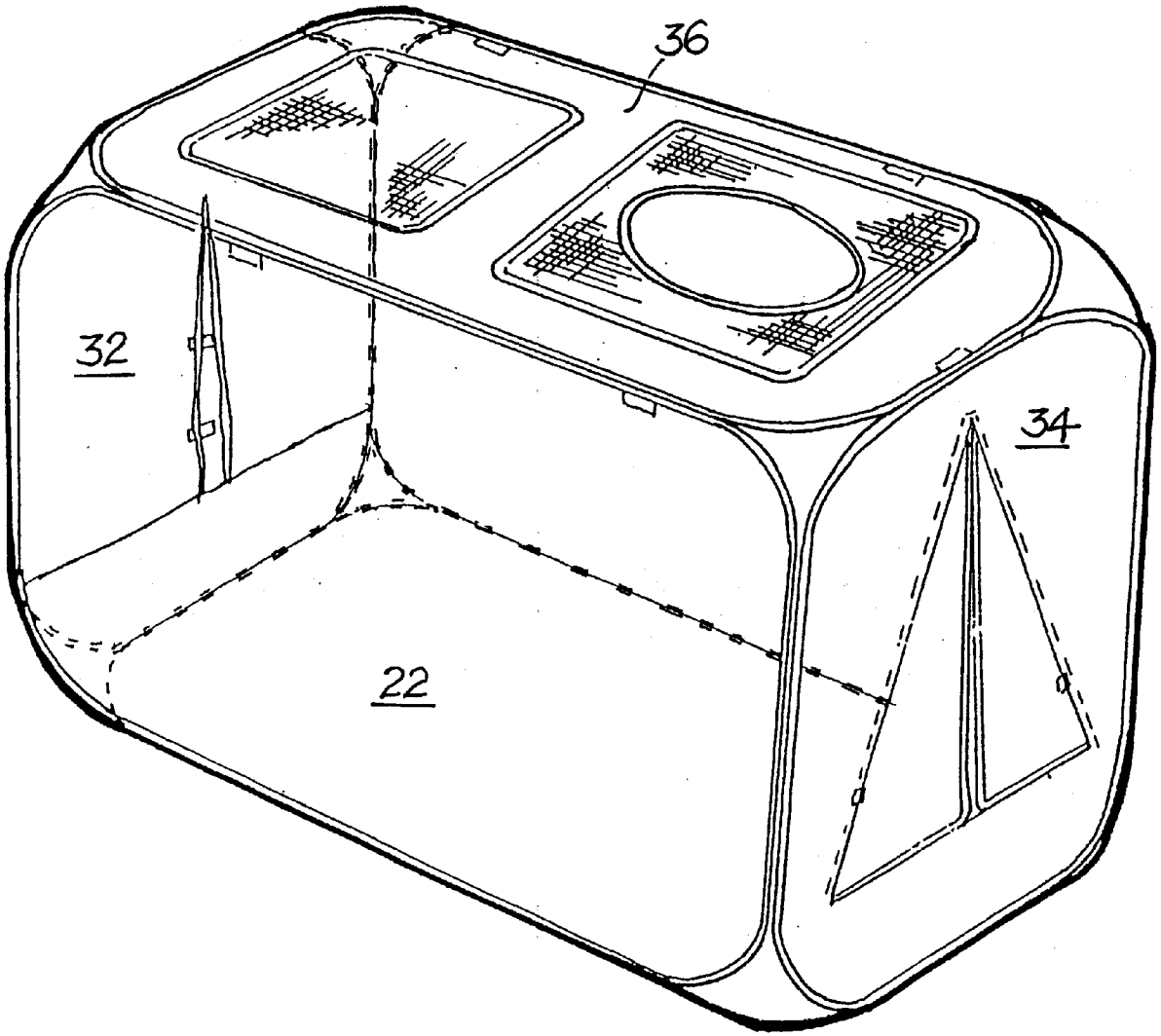
FIG. 1E shows a perspective view of the same embodiment with the top structure attached. For clarify of illustration, the hidden sides of the panels are also shown.
Figure 1F:
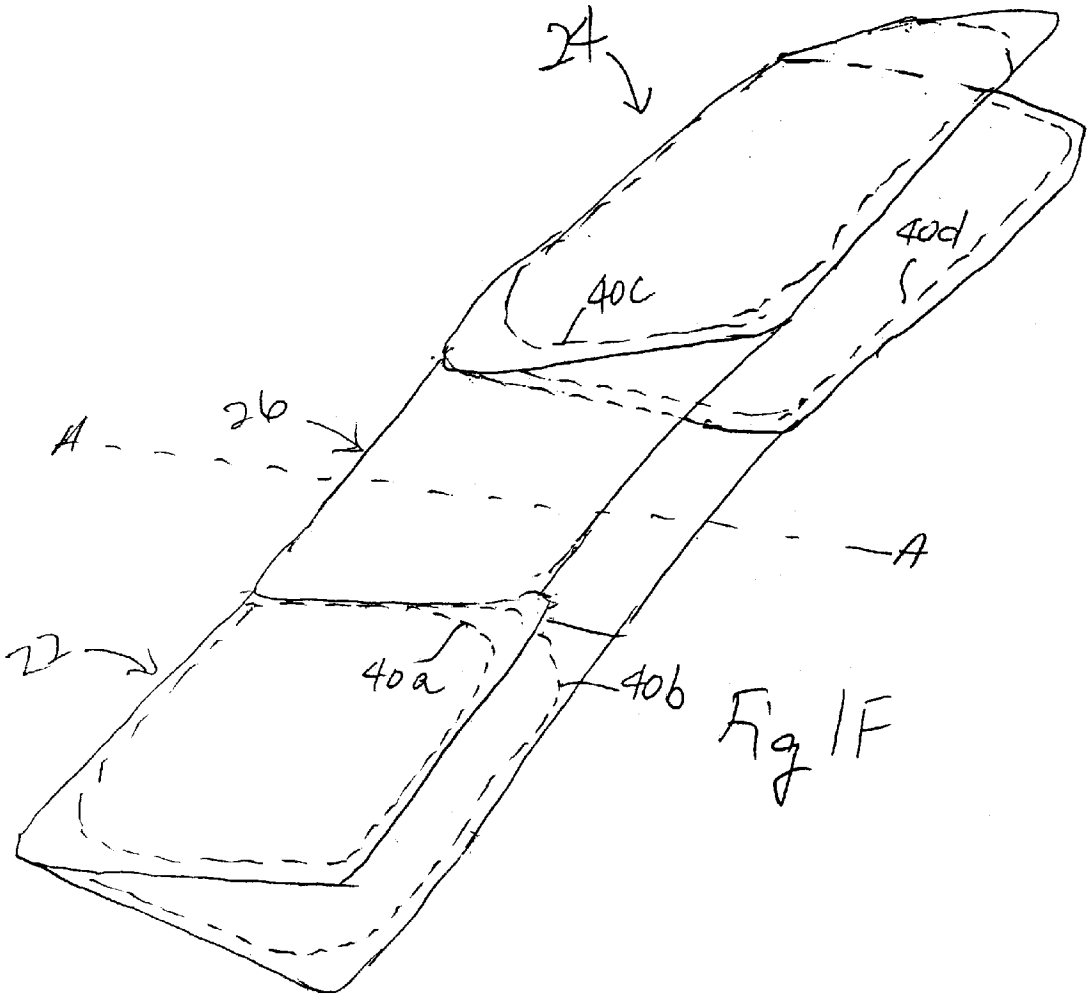
FIG. 1F shows how the two connected side panels may be folded and stacked together.

Referring first to FIGS. 1A to 1E, one embodiment of the present invention contains two opposing side panels 22 and 24 that are connected theretogether by a rectangular shaped bottom fabric 26. In this embodiment, panel 22 contains two loops 40*a* and 40*b* each defining a flat surface. The two loops are placed juxtaposing each other with their respective flat surfaces defining the flat surface of the side panel and with a fabric placed across the two loops and sewn together such that they form a single side panel. Side panel 24 is also similarly constructed with two loops 40*c* and 40*d* positioned juxtaposing each other and another panel sewn thereover to form a single panel. The two side panels 22 and 24 are sewn together on opposing sides of a rectangular shaped bottom panel. Since the loops are rigid, the direction of movement for the two side panels relative to the bottom panel is typically a rotational movement about an axis defined by the bottom side of each side panel in the direction as shown by the arrow and is hereinafter referred to as a hinged connection. The rotational movement allowed by the hinged connection is simply due to the flexibility of the fabric material. In the preferred embodiment, there is no requirement to install an actual hinge in the side panel or bottom panel, although such hinges are not excluded from the scope of the instant invention. The hinged connection, however, does not preclude the 2 frames of the same panel from rotating towards each other at 90 degrees from the hinged connection as shown in FIG. 1F and explained later. In this embodiment two long half zippers 28 and 30 are provided with one half sewn on either side of side panel 24 across bottom panel 26 and all the way along the sides 22*d* and 22*b* of the side panels 22 and 24 respectively. In greater detail as shown in FIGS. 1A and 1B, the half-zipper 30 starts from a corner fabric flap 24*a* of frame 24 and extend along the side 24*b* of panel 24 down to one end 26*b* of bottom panel 26 along the side 22*b* of panel 22 and ends with attachment to a fabric flap 22*a* that extends from the corner of side panel 22. Similarly, half-zipper 28 starts from a corner fabric flap 22*c* of frame 22 and extend along the side 22*d* of panel 22 down to the other end 26*c* of the bottom panel 26 along the side 24*d* of panel 24 and ends with attachment to a fabric flap 24*c* that extends from the comer of side panel 24.

End panels 32 and 34 as shown in FIG. 1B contains the other half-zipper 32*a* and 34*a* respectively that are adapted for complementary zipping with half-zippers 28 and 30 respectively. As shown in FIG. 1C, end panel 34 contains zipper 34*a* that allows the panel to be attached to flap 24*a* and side 24*b* of side panel 24. Further attachment is provided with end 26*b* of bottom panel 26 and across to side 22*b* of side panel 22. The zipper 34*a* finally zip up from an extension flap 22*c* that extends from the upper top corner of side panel 22. Once the side panels are attached, a rectangularly shaped open structure is defined as shown in FIG. 1D. In this embodiment, a top is also provided and is attachable to the rectangular structure using Velcro™ tape 38*a* that may be attachable to the complementary Velcro™ side 38*b* that is provided on side panel 22 and 24 and also along the top edge of end panels 32 and 34.

In this embodiment, side panels 22 and 24 each consists of two loop frames that are shown as 40*a* to 40*d* are shown in FIGS. 1A and 1D. The same frame is not illustrated in FIG. 1E in order not to obscure the structure are shown. The possibility of using twin frames for the side panel shows one advantage of the instant invention. The side panel can be unfolded and the two frames 40*a* and 40*b* of the same panel may be folded as shown in FIG. 1F such that they overlay each other. Each of the twin frames may also be folded along line A—A as shown in FIG. 1F such that all four frames may be unzipped and folded to aligned one above another. Since the end panel 32 and 34 are completely detachable, they may also be put on top of these stacks of frames such that all the frames may now be twisted together to from concentric loops simultaneously for ease of storage.

Figure 2A:
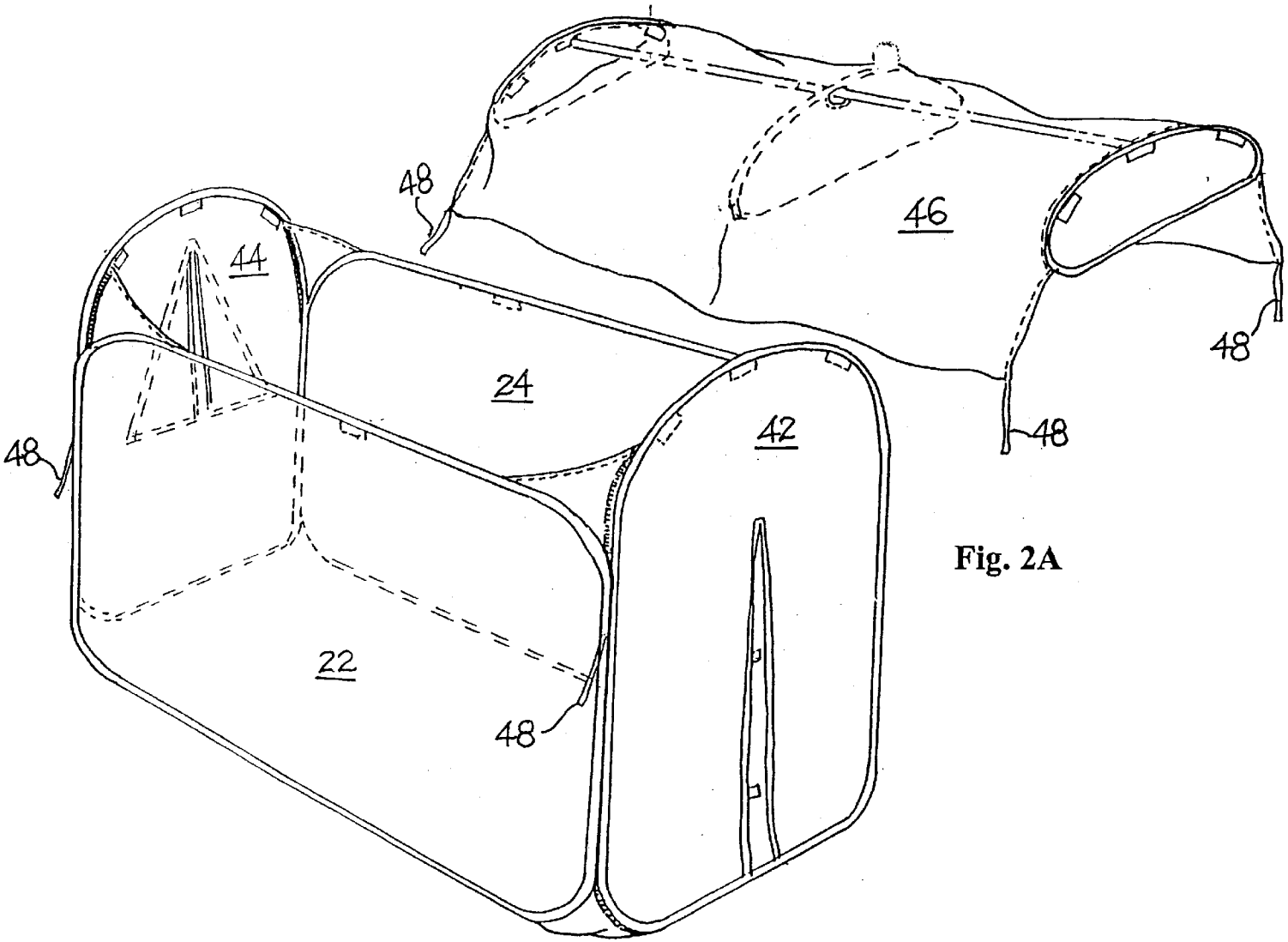
FIG. 2A shows a second embodiment according to the present invention in which the side panels are similar to the one shown in the first embodiment but the top assume the look of a wagon.
Figure 2B:
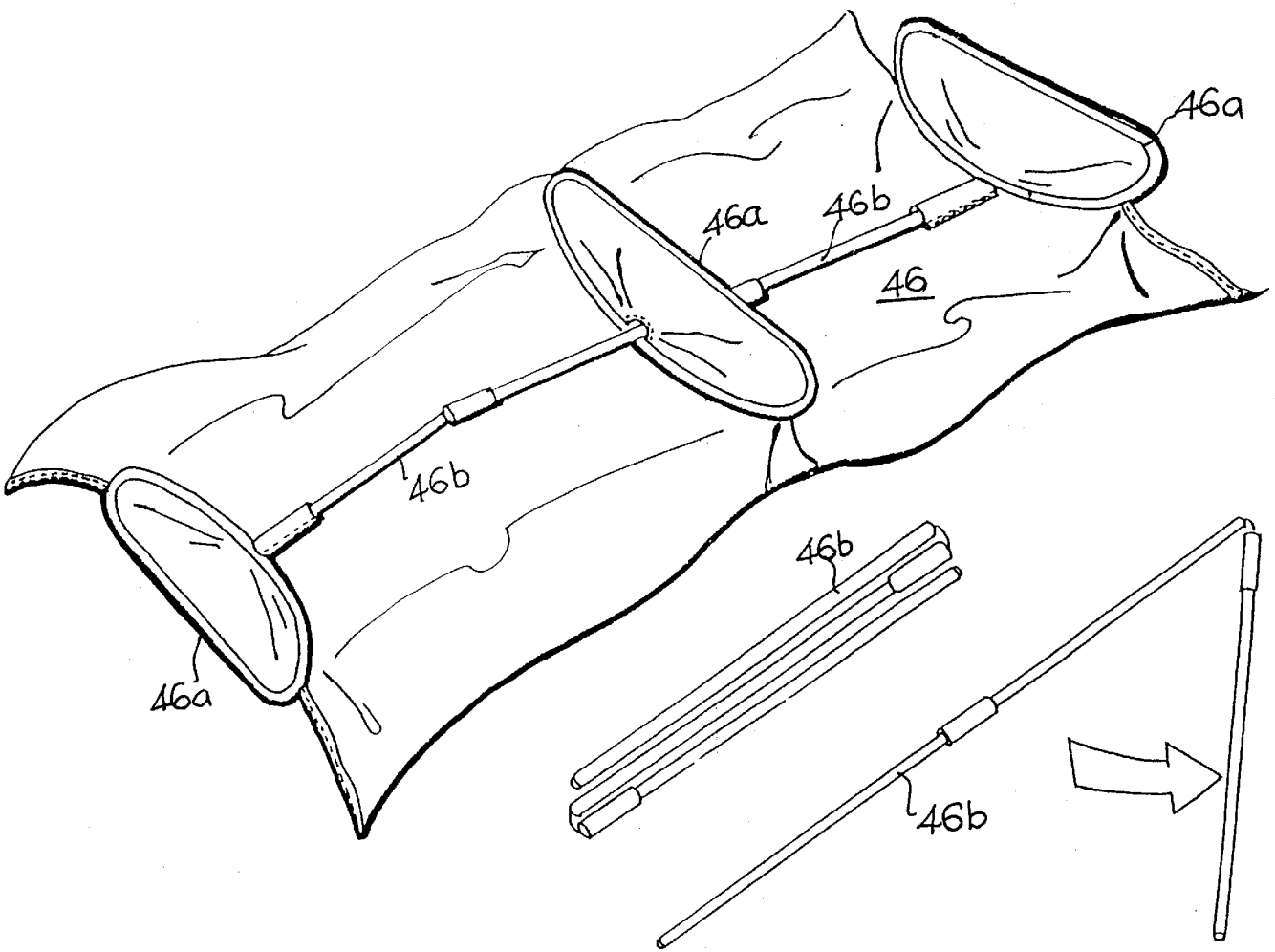
FIG. 2B shows the bottom side of the wagon top.
Figure 2C:
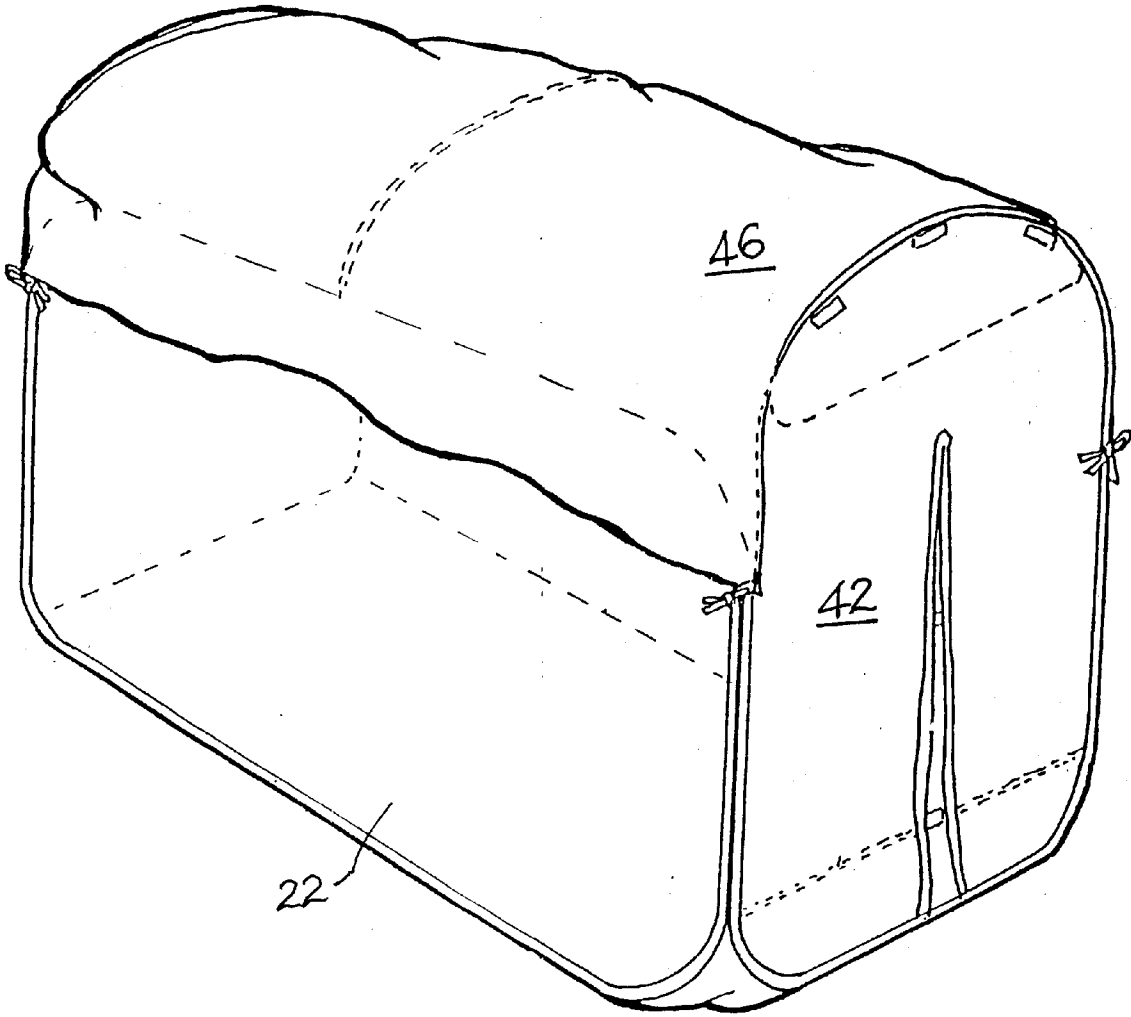
FIG. 2C is a perspective view of the assembled structure according to the same embodiment as FIG. 2A.
Figure 3A:
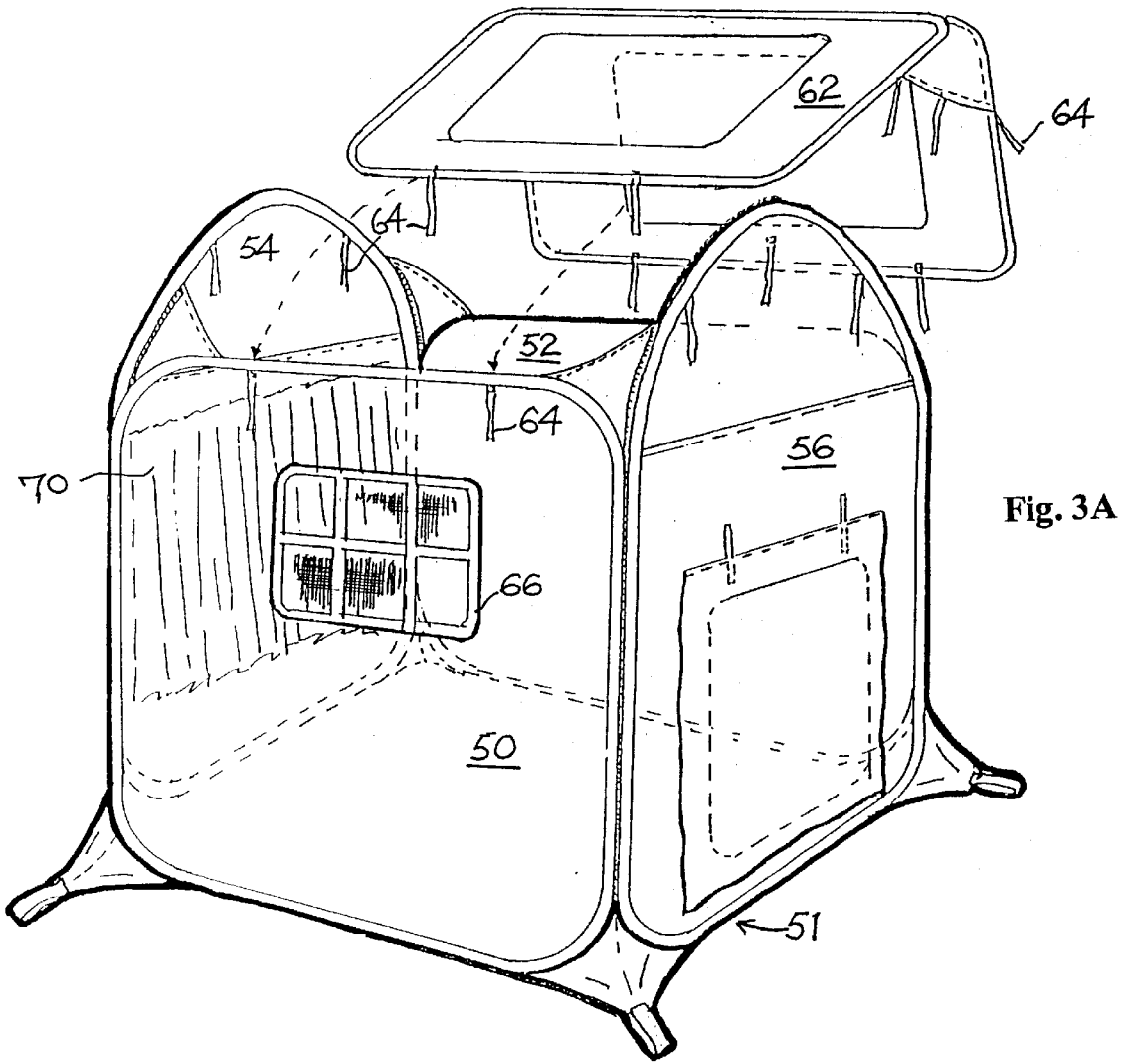
FIG. 3A shows a third embodiment in which a rooftop is provided above the side panels.
Figure 3B:
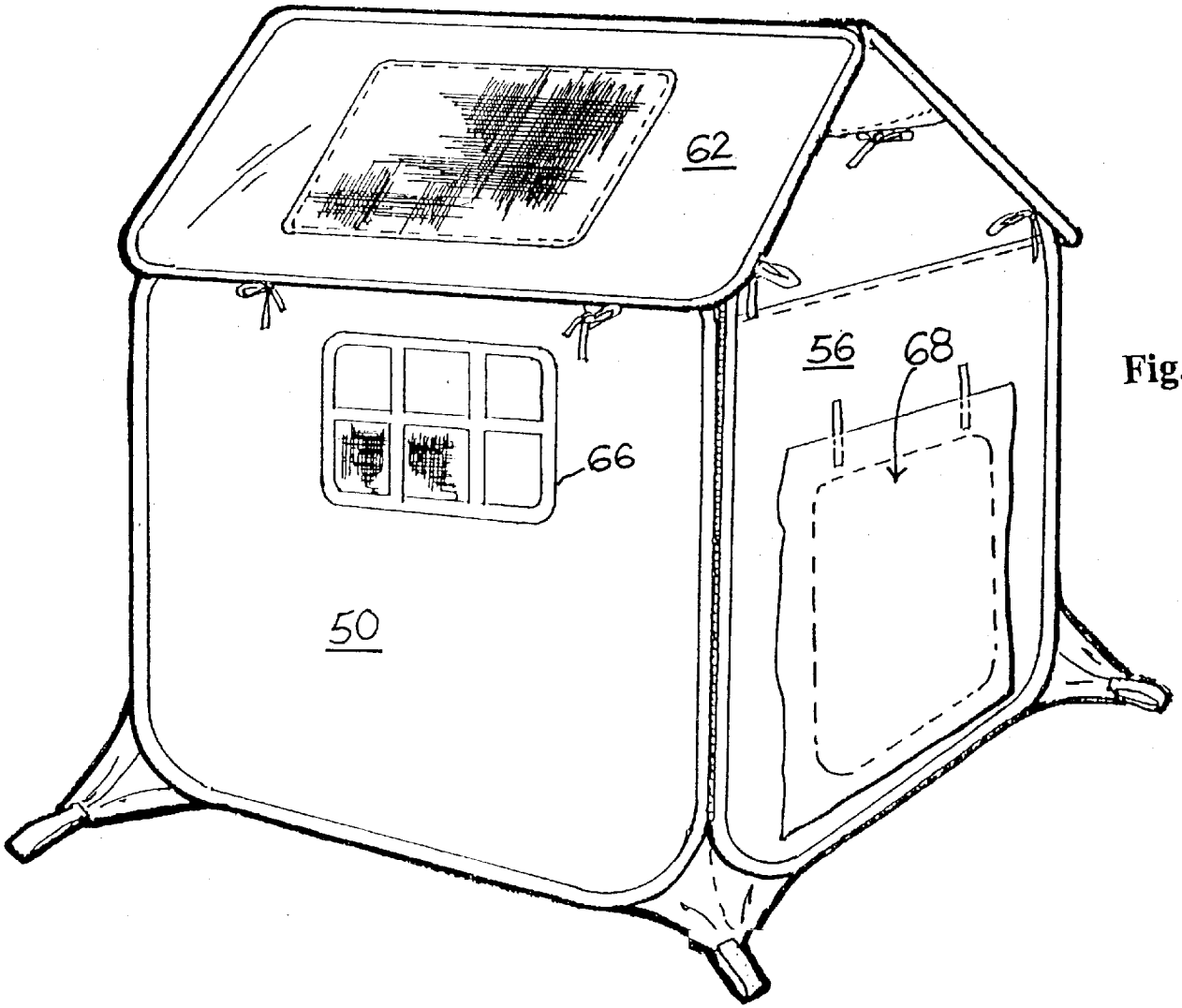
FIG. 3B shows a perspective view of the same embodiment as FIG. 3A with the rooftop attached thereto.
Figure 3C:
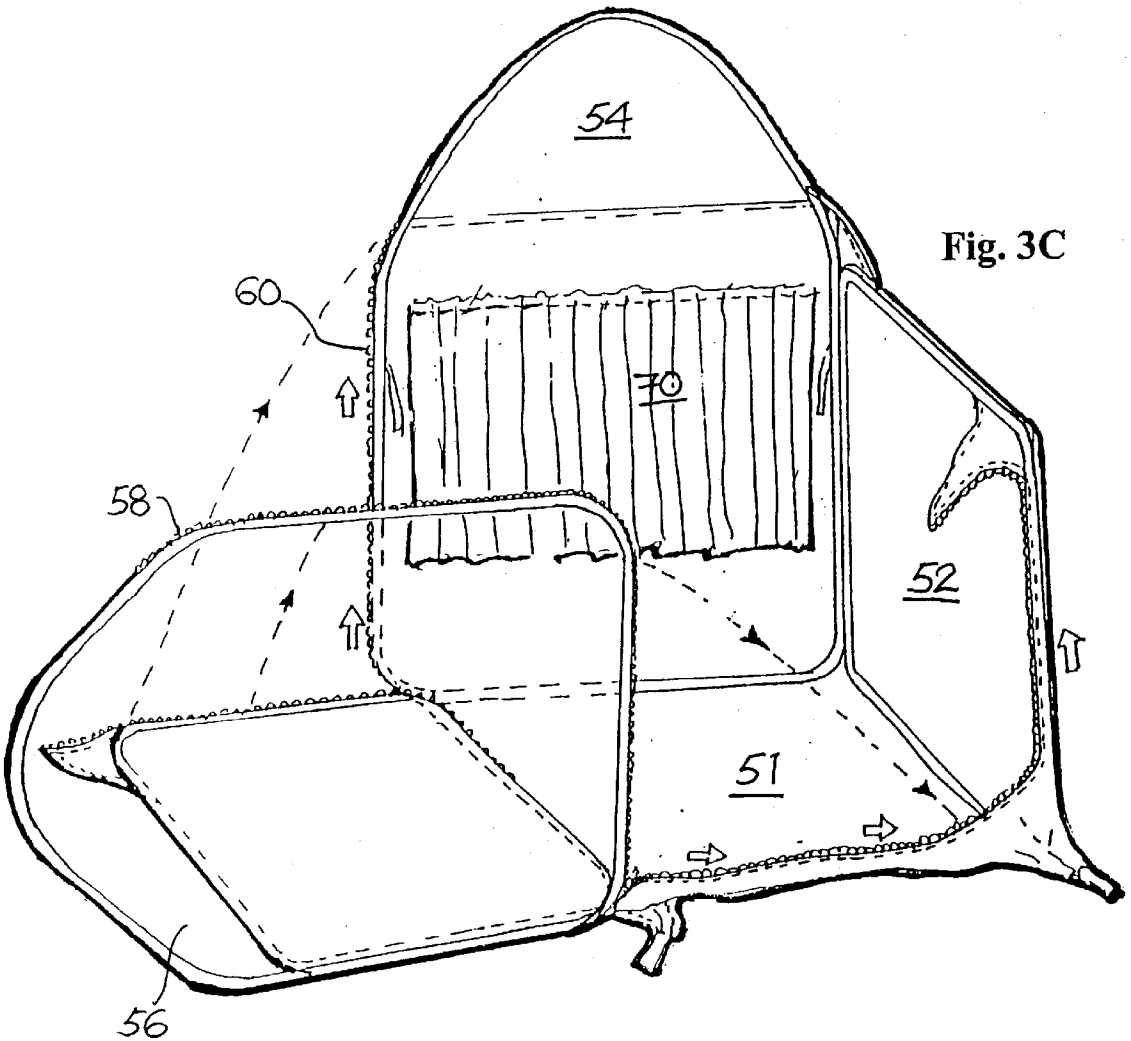
FIG. 3C shows the same embodiment as FIG. 3A with the detachable side panel partially detached.
Figure 3D:
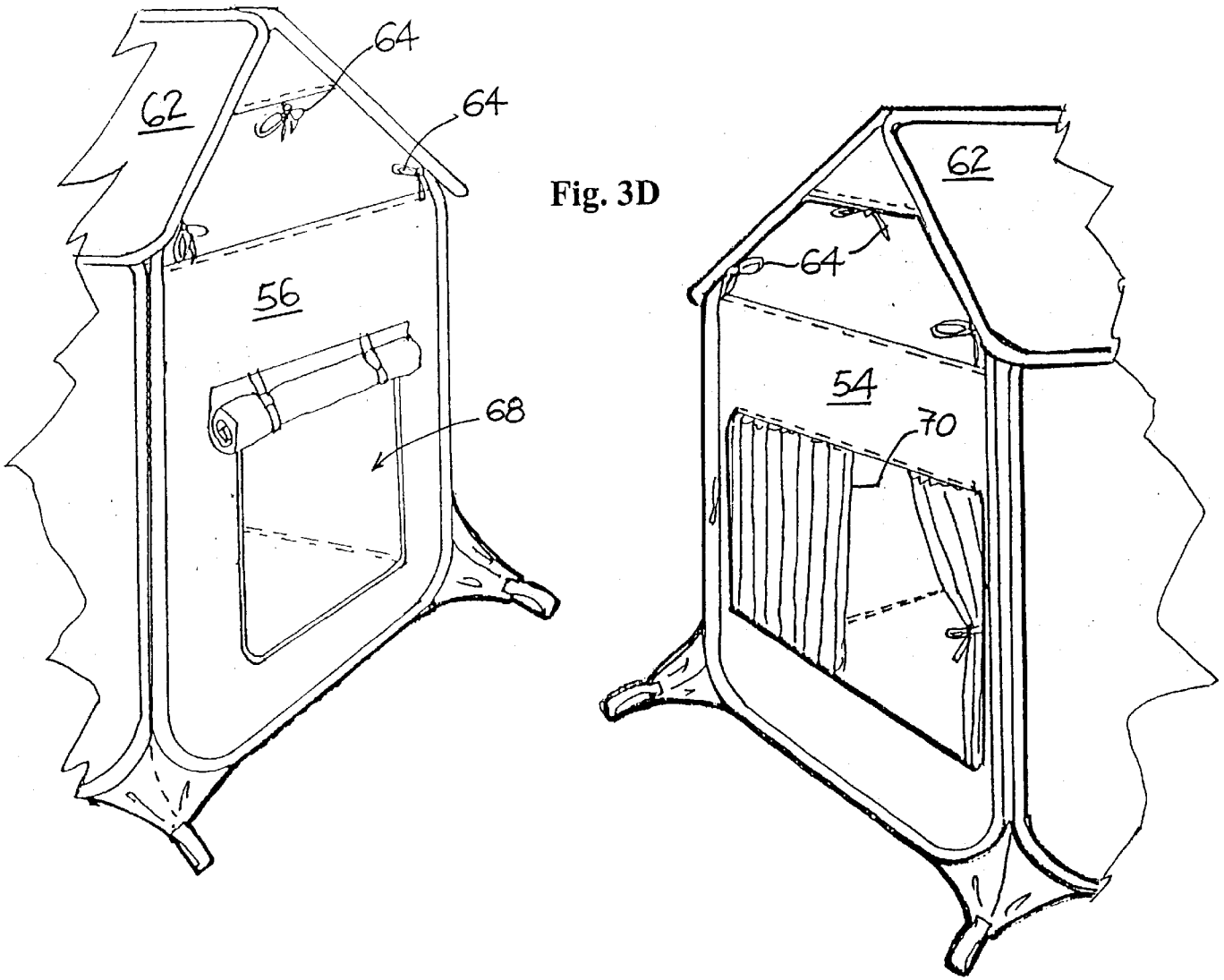
FIG. 3D shows the partial views of the same embodiment as FIG. 3A illustrating how different detachable end panels may be provided and inter-changeable therebetween.

FIGS. 2A to 2C shows a similar embodiment of the same invention except that the end panels 32 and 34 are replaced by taller end panels 42 and 44 and top 36 is replaced by wagon top 46. Top 46 also contains three identical loops 46*a* that may be kept apart by extendible rods 46*b*. The wagon top is then tied onto the frame by lengths of fabric 48 that are provided at the appropriate places.

FIGS. 3A to 3D show another embodiment of the present invention in which side panels 50 and 52 each formed by a single loop are attached at the bottom by a bottom panel 51. End panel 54 and 56 are completely detachable by unzipping zippers 58 and 60 (see FIG. 3C). The end panels 54 and 56 have heights that are higher than side panel 50 and 54 such that a downward-sloping rooftop 62 may be supported above the end panels. The rooftop 62 may be attached to the side structure via attachment strings 64 that are provided at the appropriate places. In this example, a window 66 is provided on side panel 50 and a door 68 provided on end panel 56 such that these structures may appear like a house. The other end panel 54 contains a window with curtain 70 that may be used as a public stage or Theatre.

Figure 4A:
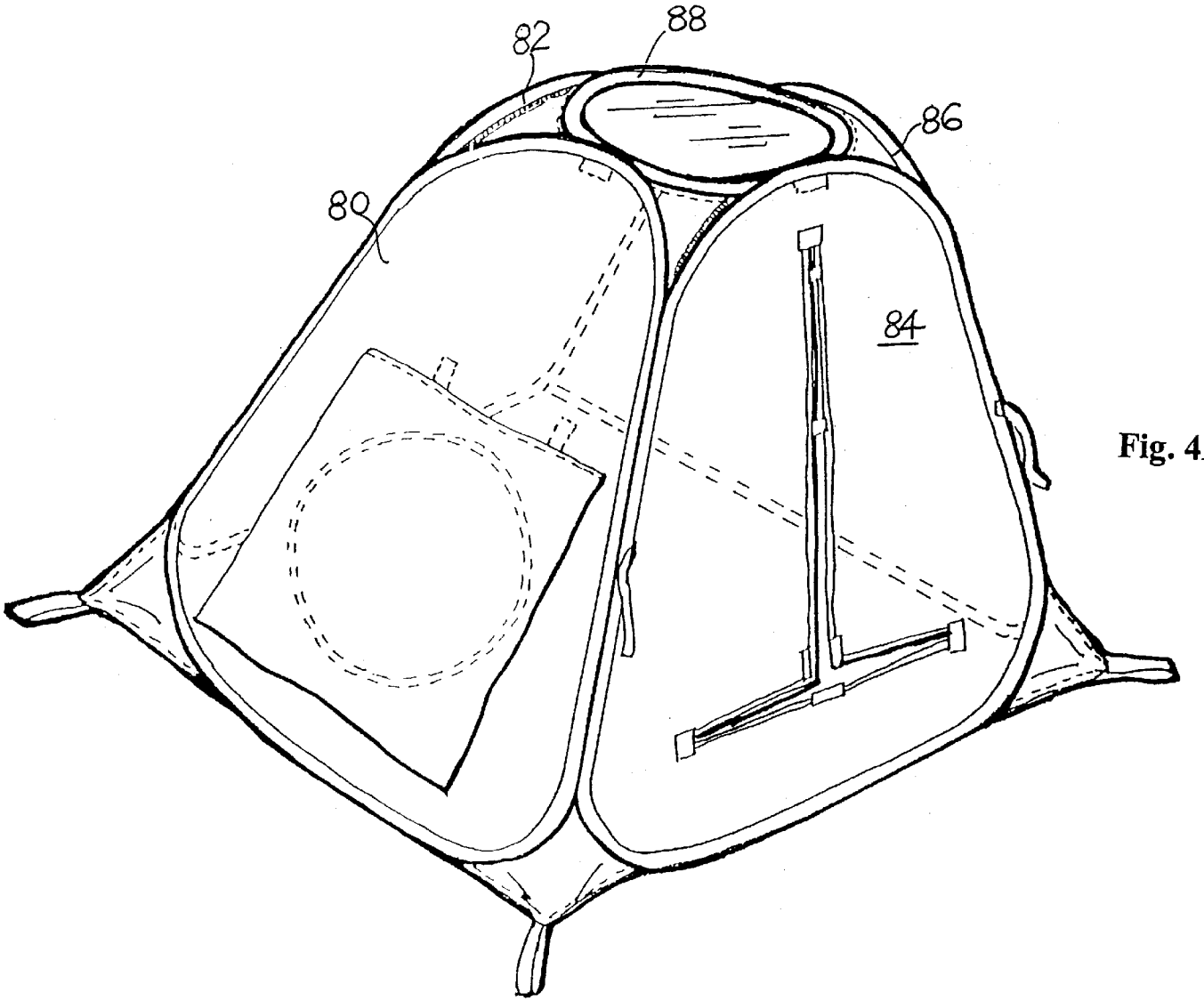
FIG. 4A shows a fourth embodiment according to the present invention in which an teepee structure is shown.
Figure 4B:
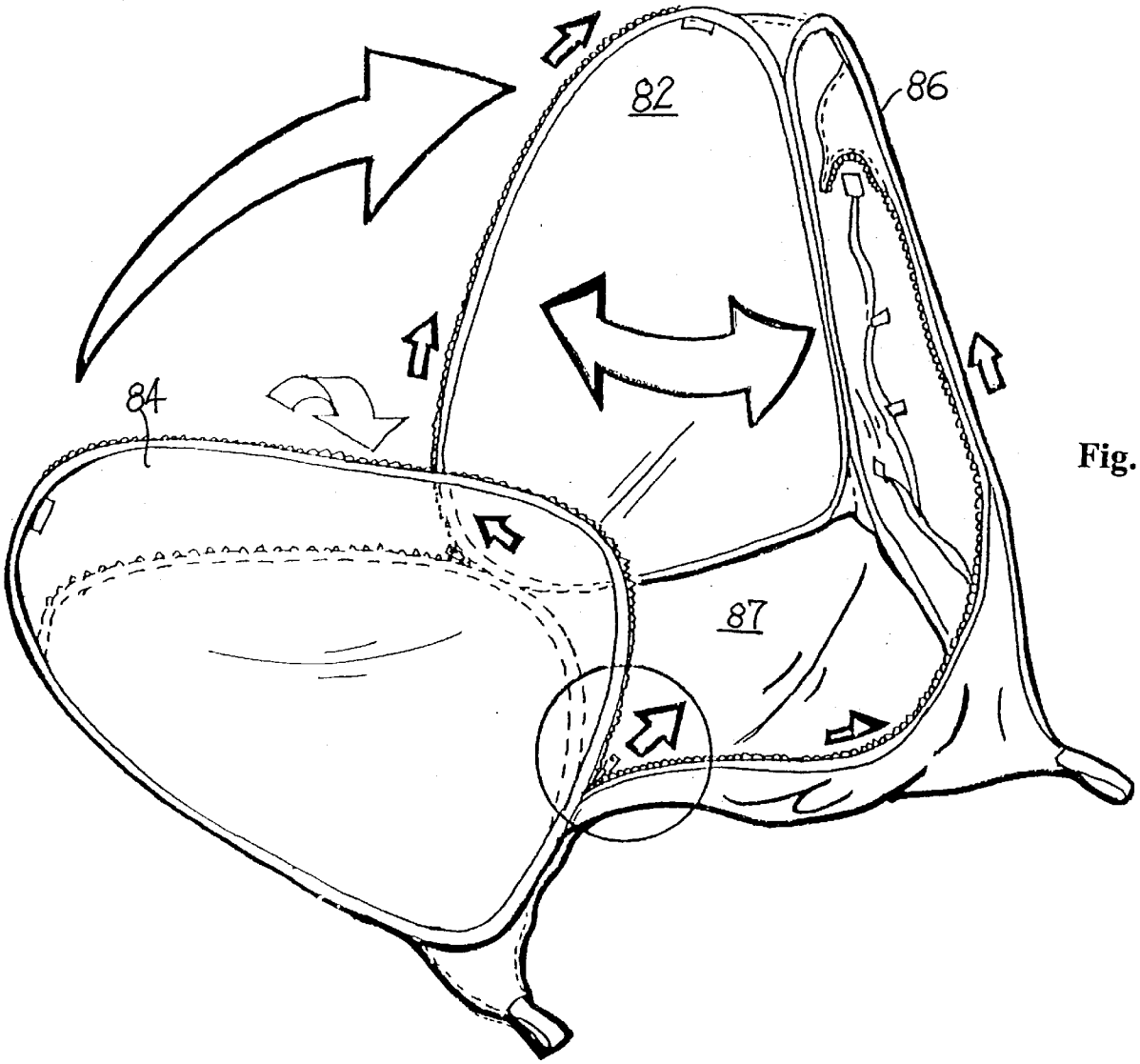
FIG. 4B is a diagram to show how the side panels in FIG. 4A may be detachable by unzipping therefrom.
Figure 4C:
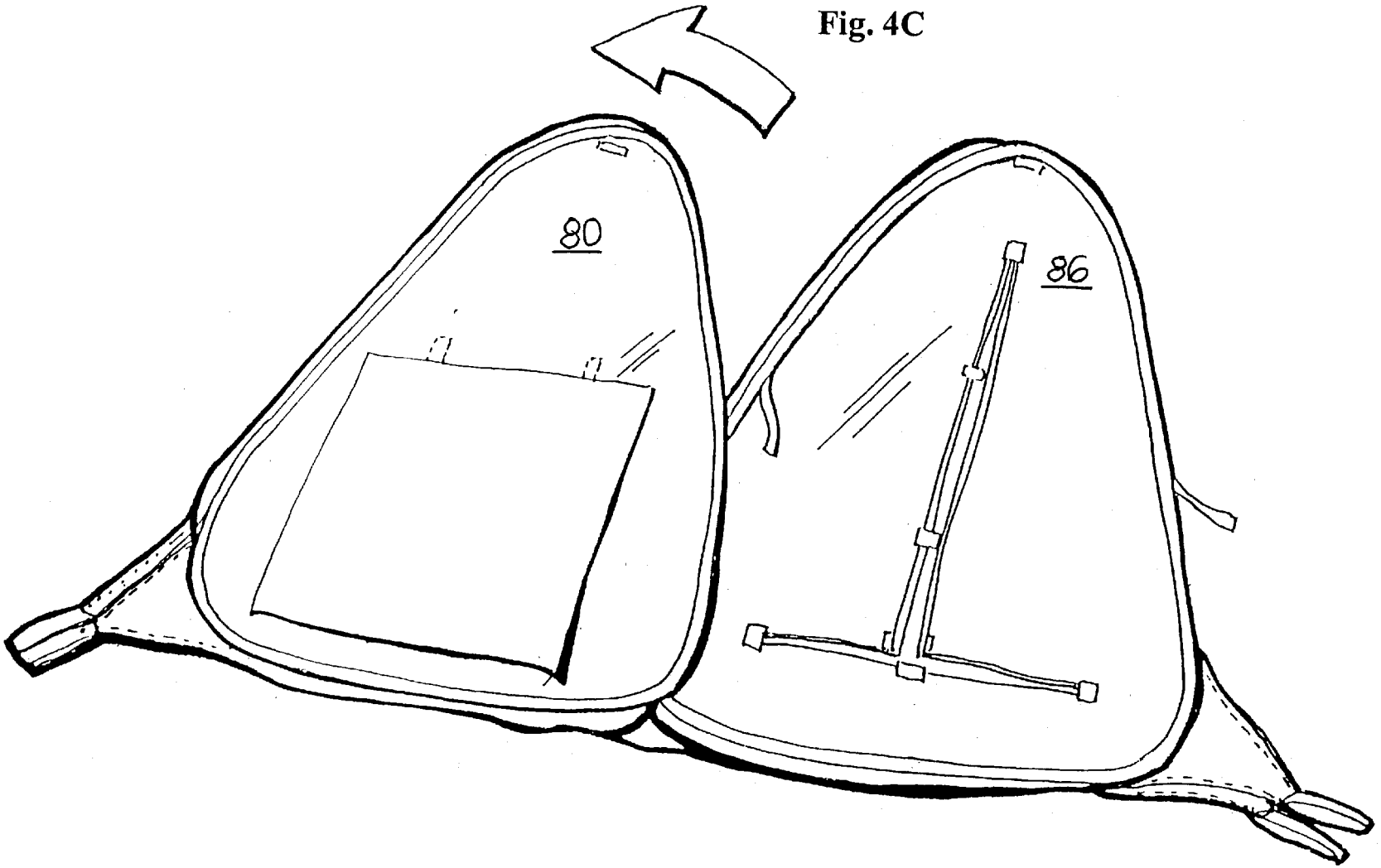
FIG. 4C shows unzipped or detached side panels that are aligned with the neighbouring panel in preparation for folding the panels into the collapsed form.
Figure 4D:
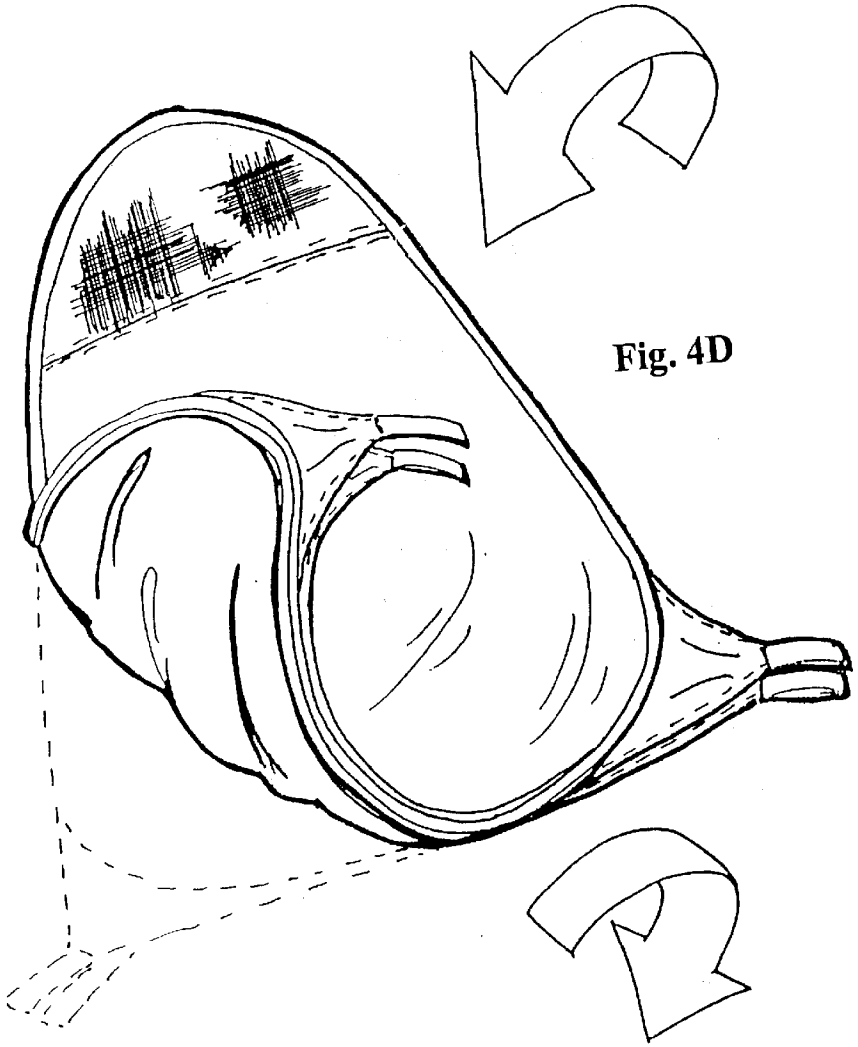
FIG. 4D is a diagrammatic representation of the four side panels shown in FIG. 4A being superimposed and aligned one on top of another and with one comer of the side panel being twisted to illustrate how the collapsible form may be obtained.
Figure 4E:
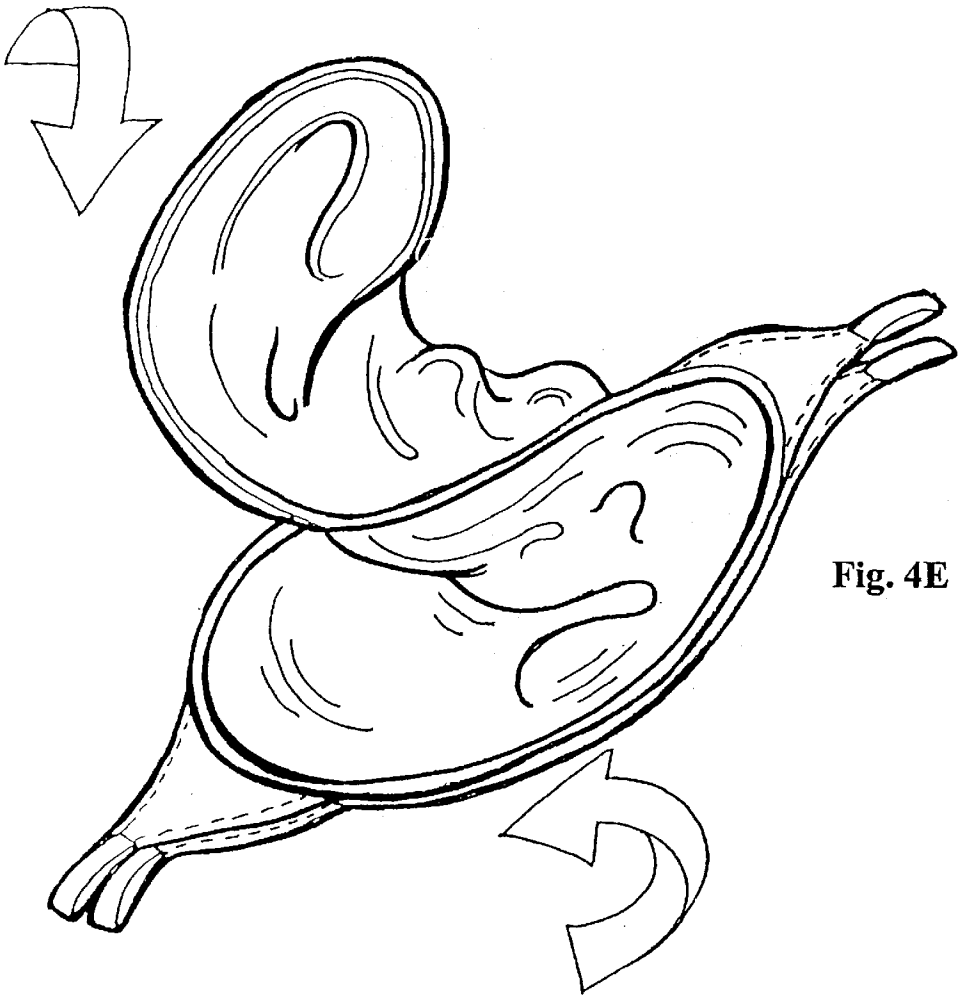
FIG. 4E shows the second step of the folding process of the same example shown in FIG. 4D.
Figure 4F:
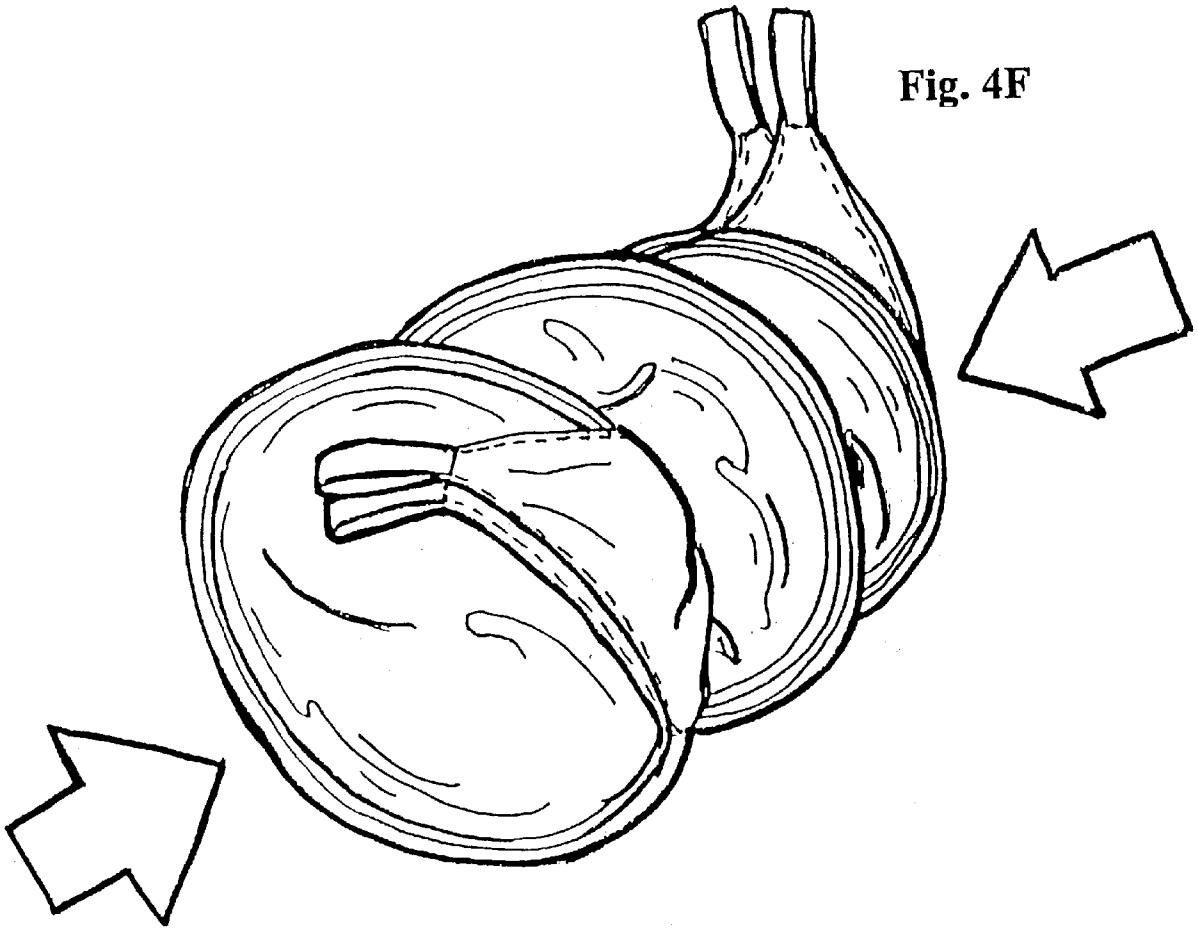
FIG. 4F shows the final step of the folding process of the same embodiment in which one loop-shaped frame is folded into three concentric loops.

Referring to FIGS. 4A to 4F, a fourth embodiment of the present invention contains a structure that assumes the shape of an Indian teepee tent. The tent contains four panels 80, 82, 84 and 86 that have identical shapes of a substantially triangular form with two neighbouring panels 80 and 84 hingedly connected by the side and the opposing two neighbouring panels 82 and 86 also hingedly connected at the side. A zippers is provided for attachment between panels 80 and 82. Another zipper is provided for attachment between panels 84 and 86. These zippers also run along the bottom of panels 80 and 84 for attachment to the bottom panel 87. In this way, the two connected side panels 80 and 84 may be completely detached from the other side panels and also from the bottom panel 87. Thus, bottom panel 87 is permanently connected to side panels 82 and 86 and may be folded theretogether during the storage process. After detachment, the panels are shown in FIG. 4C with panels 80 and 84 (panel 84 not shown as it is behind panel 80) forming one group and panels 82 and 86 forming another group (panel 82 also not shown as it is behind panel 86 in FIG. 4C). All four panels may then be stacked together as shown in FIG. 4D and twisted according to the steps shown in FIGS. 4D to 4F into a recoiled position of three concentric loops to reduce the size for ease of storage.

While the above examples are used to illustrate various aspects of the present invention, it is clear that they are for illustration only and are not meant to limit the scope of the invention as claimed herein. Nevertheless, these examples served to illustrate the versatility of the instant invention. For example, the top illustrated in FIGS. 1D and 1E assumes the appearance of an opening vehicle while a wagon top and a rooftop are shown in subsequent examples. These tops require side panels with different heights in order to make their shape realistic and the technical solution according to the present invention is to inter-change the various side panels conveniently by providing attachment means thereto. Furthermore, it is clear that tops of many other shapes may be produced and adapted for use according to the present invention. For example, tops that are conical, dome, pyramidal or tapered in shape may also be inter-changed according to the present invention. Although zippers are used in the examples and is the preferred means for attachment of the end panels to the bottom panel and the side panels, it is clear that other means of attachment, such as simple strings and lengths of fabric may be used to tie the side panels together. In the preferred embodiment, the end panels are attached not only to the frame of the side panel, but also to the extending corner flaps such that the structures are very stable. The comer flaps provide anchoring points for improved stability of the side panels.

In addition to the completely detachable end panels as described above, it is also possible for the end panel to be detachable from the bottom panel and one of the side panel, while hingedly connected to the other side panel. This specific embodiment would not conveniently allow for changeability of the end panels, but would still allow the side panel to assume various lengths and shapes, since each end panel can still be folded together with the connected side panel. This can easily be done by changing to a shorter zipper and permanently sewing one side of the end panel to one side of a side panel.

If the end panels are completely detachable, the side panels may assume a long rectangular shape even with the use of a single frame for each side panel. Once the end panel are detached from the side panels, the side panels may be stacked together and twisted into their recoiled position.

What is claimed is:

1. A portable and reversibly collapsible structure comprising:

a) a bottom comprising a bottom panel; and b) a plurality of side panels, each said side panel containing a fabric material connected to at least one frame, each said frame foldable between an expanded position and a recoiled position, said plurality of side panels comprising:

(i) at least two side panels hingedly connected to opposing sides of said bottom panel forming a hinged connection between each said side panels and said bottom panel respectively; and (ii) at least one detachable side panel provided with attachment means for attachment to said bottom panel and said opposing side panels, the attachment between said detachable side panel and said bottom panel being reversibly detachable by a user, the attachment between said detachable side panel and one of said opposing side panels is also reversibly detachable by said end user, whereby side panels may be conveniently recoiled together, and wherein each of said hingedly connected side panels can rotate independently around its respective hinged connection to the bottom panel when said detachable side panels are detached therefrom.

2. A structure according to claim 1 wherein four side panels and a quadrilateral bottom panel are provided, said bottom panel having two opposing edges interposing two opposing ends; said structure further characterized in that said side panels comprises two connected side panels, each having a bottom edge hingedly connected to one of said opposing edges of said bottom panel respectively; and two detachable side panels provided between said connected side panels and each having a top end, a bottom end, two sides and attachment means, said attachment means adapted for reversible attachment of said bottom end to said bottom panel and one of said sides to one side of one said connected side panel, said detachable side panel further hingedly connected to one side of the other connected side panel.

3. A structure according to claim 1 wherein four side panels and a quadrilateral bottom panel are provided, said bottom panel having two opposing edges interposing two opposing ends, said structure further characterized in that two connected side panels are connected to said opposing edges of said bottom panel; and two detachable side panels are detachably connected to said opposing ends of said bottom panel respectively, said detachable side panels further detachably connected to both said connected side panels.

4. A structure according to any one of claim 1 wherein at least two opposing connected side panels each comprises two frames hingedly adjoined to form a single substantially rectangular side panel.

5. A structure according to any one of claim 1, wherein a top is further provided for said structure, said top detachably connected to said side panels.

6. A structure according to any one of claim 1, wherein corner flaps are provided in at least one of the said side panels, said attachment means further allowing said corner flap to be reversibly attached to a neighboring panel.

7. A structure according to any one of claim 2 wherein at least two opposing connected side panels each comprises two frames hingedly adjoined to form a single substantially rectangular side panel.

8. A structure according to any one of claim 3 wherein at least two opposing connected side panels each comprises two frames hingedly adjoined to form a single substantially rectangular side panel.

9. A structure according to any one of claim 2, wherein a top is further provided for said structure, said top detachably connected to said side panels.

10. A structure according to any one of claim 3, wherein a top is further provided for said structure, said top detachably connected to said side panels.

11. A structure according to any one of claim 2, wherein corner flaps are provided in at least one of the said side panels, said attachment means further allowing said corner flap to be reversibly attached to a neighboring panel.

12. A structure according to any one of claim 3, wherein corner flaps are provided in at least one of the said side panels, said attachment means further allowing said corner flap to be reversibly attached to a neighboring panel.

13. A portable and reversibly collapsible structure comprising:

a) a bottom comprising a bottom panel; and b) a plurality of side panels, each said side panel containing a fabric material connected to at least one frame, each said frame foldable between an expanded position and a recoiled position, said plurality of side panels comprising:

(i) at least two neighboring side panels hingedly connected to neighboring sides of said bottom panel forming a panel set with said neighboring side panels connected side by side;

(ii) at least one detachable side panel provided with reversible attachment means for attachment to said panel set.

14. A collapsible structure according to claim 13, wherein the side-by-side connection between said neighboring side panels is reversibly detachable through a reversible attachment means provided therein.

15. A structure according to claim 13, wherein a first pair of side panels, a second pair of side panels and a quadrilateral bottom panel are provided, wherein each said pairs of side panels having a bottom end and a top end hingedly connected by the side thereinbetween; said bottom panel having a pair of neighboring edges opposite to a pair of neighboring ends; said first pair of side panels hingedly connected to said pair of neighbouring edges at its bottom end forming a panel set; said second pair of side panels detachably connected to said panel set; and attachment means is provided for reversible attachment of said second pair of side panels to said panel set.

16. A structure according to claim 13 wherein four side panels and a quadrilateral bottom panel are provided, said bottom panel having a pair of neighboring edges opposite to a pair of neighboring ends, said structure further characterized in that two connected side panels are connected to said neighboring edges of said bottom panel; and two detachable side panels are detachably connected to said neighboring ends of said bottom panel respectively, said detachable side panels further detachably connected to both said connected side panels.

17. A structure according to any one of claims 13, wherein a top is further provided for said structure, said top detachably connected to said side panels.

18. A structure according to any one of claims 13, wherein corner flaps are provided in at least one of the said side panels, said attachment means further allowing said corner flap to be reversibly attached to a neighbouring panel.

* * * * *

UNITED STATES PATENT AND TRADEMARK OFFICE

CERTIFICATE OF CORRECTION

PATENT NO. : 6,782,905 B2
DATED : August 31, 2004
INVENTOR(S) : Wan-sing Chu et al.

It is certified that error appears in the above-identified patent and that said Letters Patent is hereby corrected as shown below:

Title page,
Item [*] Notice, “93” should read -- 96 --.

Signed and Sealed this

Sixteenth Day of November, 2004

JON W. DUDAS
*Director of the United States Patent and Trademark Office*